US005203687A

United States Patent [19]

Oguchi

[11] Patent Number: 5,203,687

[45] Date of Patent: Apr. 20, 1993

[54] CONTROL SYSTEM FOR BURNER

[75] Inventor: Yukihiro Oguchi, Aichi, Japan

[73] Assignee: Toyotomi Co., Ltd., Aichi, Japan

[21] Appl. No.: 669,686

[22] Filed: Mar. 14, 1991

[30] Foreign Application Priority Data

Aug. 27, 1990 [JP] Japan ..... 2-226267

[51] Int. Cl.[5] ..... F23N 5/00; F23N 5/26

[52] U.S. Cl. ..... 431/14; 431/76; 431/18; 431/13; 236/15 F

[58] Field of Search ..... 431/77, 14, 13, 18, 431/76; 236/15 E

[56] References Cited

U.S. PATENT DOCUMENTS 4,423,487 12/1983 Buckenham et al. .
4,482,311 11/1984 Wada et al. ..... 431/76 X
4,525,137 6/1985 Tomioka et al. ..... 431/76
4,588,371 5/1986 Nakamura et al. .
4,710,125 12/1987 Nakamura et al. ..... 431/22

FOREIGN PATENT DOCUMENTS 0085224 8/1983 European Pat. Off. .
008028 5/1985 Japan ..... 431/22
2064780 6/1981 United Kingdom .
2140550 11/1984 United Kingdom .

*Primary Examiner*—Carl D. Price
*Attorney, Agent, or Firm*—Pollock, Vande Sande & Priddy

[57] ABSTRACT

A control system for a burner is disclosed which detects oxygen concentration in a room using an oxygen sensor, to thereby supply an abnormality detecting signal to at least one of an alarm and a combustion reducing device to actuate it when oxygen concentration is lowered below a predetermined set value. A first comparing device and a reference value storing device are used to cause maximum oxygen concentration detected to be stored as an oxygen concentration reference value in the storing device. A second comparing device compares the deviation between the oxygen concentration reference value and a detected oxygen concentration value with an abnormality judging reference value, to thereby generate the abnormality detecting signal when the deviation is larger than the reference value. The control system is capable of effectively detecting a low oxygen concentration condition without being affected by an ambient temperature.

20 Claims, 5 Drawing Sheets

CONTROL SYSTEM FOR BURNER

BACKGROUND OF THE INVENTION

This invention relates to a control system for a burner adapted to directly detect oxygen concentration in a room in which a burner is placed, to thereby prevent abnormal combustion due to a decrease in oxygen, and more particularly to a control system for a burner for detecting oxygen concentration in the room using an oxygen sensor adapted to react with gaseous oxygen to generate its output depending upon the concentration of oxygen such as a gas sensor of the galvanic cell type, to thereby generate an abnormality detecting signal to actuate at least one of an alarm and a combustion reducing device when the oxygen concentration in the room is lowered to a level below a predetermined set value.

The use of a combustion appliance or burner such as an oil-fired space heater, a gas-fired space heater or the like for heating a tightly closed room causes a reduction in oxygen due to combustion, leading to incomplete combustion of fuel in the burner. In view of the above, various techniques have been conventionally developed to detect a reduction in oxygen. For example, U.S. Pat. No. 4,710,125 proposes a system for indirectly detecting lack of oxygen based on a variation in flame current utilizing characteristics of a burner to generate an abnormality detecting signal. Also, a system wherein an oxygen concentration cell using zirconium is used for detecting a difference in oxygen partial pressure between air in a room in which a burner is placed and combustion gas discharged from the burner to generate an abnormality detecting signal is proposed. The systems proposed each are adapted to indirectly detect oxygen concentration using combustion taking place in a burner. Unfortunately, each of the proposed systems requires a relatively high voltage and a large current for the detection, therefore, it is required to use a commercial power supply. Thus, the proposed systems are not suitable for use for a burner wherein a natural draft is utilized for combustion and a dry cell or battery is used for a power supply, such as an oil burner of the wick actuating type. In view of the above, the inventors considered a system using an oxygen sensor, such as a gas sensor of the galvanic cell type, which can be driven through a dry cell or battery and is adapted to directly detect oxygen irrespective of combustion to generate an abnormality detecting signal.

An oxygen sensor for directly detecting oxygen in an environment such as a gas sensor of the galvanic cell type is generally adapted to determine oxygen within a wide range extending between 0% and 100%. Optimum oxygen concentration in a room in which a burner is placed is about 21%, whereas, in an abnormal condition due to consumption of oxygen by combustion, oxygen concentration is decreased to a level as low as 18% or less. This is generally called a low oxygen concentration condition. Thus, there is a significant difference in oxygen concentration between the optimum condition and the abnormal condition, therefore, measuring of a difference in oxygen concentration by means of the oxygen sensor causes an error because the oxygen sensor is not suitable for measuring oxygen concentration within such a narrow range with accuracy. In general, the oxygen sensor generally produces an error as large as 2 to 3% when measuring oxygen of, for example, 18% in concentration; thus, when the error is produced on the positive side, a measured value obtained by the oxygen sensor is as if oxygen concentration is within the normal range.

The major reason that the oxygen sensor which is a wet type gas sensor such as a gas sensor of the galvanic cell type and adapted to measure gas concentration according to an electrochemical procedure using an electrolyte produces an error in measuring of oxygen concentration would be that an ambient temperature of the sensor or a temperature of an environment surrounding the sensor adversely affects the oxygen sensor to vary the output of the sensor. More particularly, the oxygen sensor is generally adapted to output a degree of the reaction between a work electrode and oxygen in an atmosphere in the form of a variation in voltage, current or internal impedance. Unfortunately, the ambient temperature causes the reaction to be varied, resulting in the output of the oxygen sensor being varied. As another gas sensor which is adapted to directly measure oxygen concentration is used a gas sensor of the semiconductor type, which is likewise apt to be affected by the ambient temperature, to thereby be unsuitable for controlling the burner.

Further, the conventional various gas sensors including the gas sensor of the galvanic cell type generally exhibit characteristics distinctly different from those at a temperature at which they are usually used, when the ambient temperature is lowered to a level as near as the freezing point. Thus, it is highly desirable to eliminate such a problem.

SUMMARY OF THE INVENTION

Accordingly, it is an object of the present invention to provide a control system for a burner which is capable of accurately and positively detecting a low oxygen concentration condition without being affected by an ambient temperature while using an oxygen sensor.

It is another object of the present invention to provide a control system for a burner which is capable of effectively detecting a low oxygen concentration condition while minimizing the effect of incomplete combustion gas on the detection.

It is a further object of the present invention to provide a control system for a burner which is capable of permitting an oxygen measuring operation to be carried out after rendering the output of an oxygen sensor proportional to oxygen concentration, to thereby effectively prevent the malfunction.

It is still another object of the present invention to provide a control system for a burner which is capable of accurately generating an abnormality detecting signal, even when the combustion operation of the burner is restarted after it is once stopped.

It is yet another object of the present invention to provide a control system for a burner which is capable of effectively preventing the malfunction even when a room temperature or a temperature in a room in which the burner is placed is temporarily varied.

It is a still further object of the present invention to provide a control system for a burner which is capable of preventing the malfunction even when an oxygen sensor is deteriorated or decreased in function or an ambient temperature is excessively lowered.

It is a yet further object of the present invention to provide a control system for a burner which is capable of positively detecting a low oxygen concentration condition even when an ambient temperature is lowered to a level below a predetermined limit value.

In accordance with the present invention, there is provided a control system for a burner wherein an oxygen sensor adapted to react with gaseous oxygen to generate the output depending upon oxygen concentration is used for detecting oxygen concentration in a room in which the burner is placed, to thereby supply at least one of an alarm and a combustion reducing device with an abnormality detecting signal for actuating them when the oxygen concentration is lowered to a level below a predetermined set value. The control system comprises an oxygen concentration detecting means for receiving an electric signal supplied from the oxygen sensor and detecting oxygen concentration based on the electric signal to generate a detected oxygen concentration value which may be indicated by an electric signal such as a digital signal or the like, a first comparing means for comparing the detected oxygen concentration value with an oxygen concentration reference value which may be indicated by an electric signal such as a digital signal or the like, and a reference value storing means for storing an initial value initially input as the oxygen concentration reference value to the first comparing means. The reference value storing means is adapted to store the detected oxygen concentration value as a new or substitutional oxygen concentration reference value to provide the first comparing means with the oxygen concentration reference value, when the first comparing means detects that the detected oxygen concentration value is larger than the oxygen concentration reference value. The first comparing means and reference value storing means function to renew the oxygen concentration reference value., so that the highest oxygen concentration reference value detected after the start of operation of the control system acts as a reference value for judging a low oxygen concentration condition. Thus, supposing that optimum oxygen concentration in the room is 21%, the highest oxygen concentration value (oxygen concentration reference value) is regarded as 21%. The control system also includes a second comparing means for comparing the deviation between the detected oxygen concentration value and the oxygen concentration reference value with an abnormality judging reference value which may be indicated by an electric signal such as a digital signal or the like, resulting in generating the abnormality detecting signal if it detects that the deviation is larger than the abnormality judging reference value, when the first comparing means detects that the detected oxygen concentration value is smaller than the oxygen concentration reference value. The first and second comparing means function to detect a decrease in the highest oxygen concentration value by a predetermined amount, to thereby determine occurrence of the low oxygen concentration condition. This means that the abnormality judging reference value determines a tolerance of variation of the oxygen concentration. Supposing that the optimum oxygen concentration is 21% and oxygen concentration causing the low oxygen concentration condition is 18%, the abnormality judging reference value corresponds to 3%. Thus, it will be noted that the control system of the present invention permits oxygen concentration causing the abnormality detecting signal to be determined on the basis of the highest oxygen concentration value, so that the low oxygen concentration condition may be detected without being affected by the ambient temperature even when a variation in ambient temperature causes the detected oxygen concentration value to be varied.

In a preferred embodiment of the present invention, the burner is housed in a casing in which a duct is provided for introducing air from the room into the burner and the oxygen sensor is arranged in the duct. As described above, the oxygen sensor has characteristics of varying the output due to a variation in ambient temperature and an error of the output tends to be decreased with an increase in ambient temperature, therefore, the oxygen sensor is preferably arranged at a place in which a variation in ambient temperature is as narrow as possible. The exterior of the casing is generally increased in variation in temperature as compared with the interior and a temperature in the casing is elevated by heat discharged from the burner. Thus, it would be preferable that the oxygen sensor is arranged in the casing. However, the burner generally tends to discharge incomplete combustion gas immediately after it starts and the incomplete combustion gas is heavier than oxygen, so that it is difficult to outward discharge the incomplete combustion gas from the casing, resulting in the oxygen sensor being increased in operational error. In view of the foregoing, in the present invention, the oxygen sensor is preferably arranged in the duct. Such construction permits the oxygen sensor to be positioned at a place which is heated to a certain degree and substantially free of incomplete combustion gas, so that the oxygen sensor carries out satisfactory and accurate operation even when it is started at the state that ambient temperature is not increased.

In a preferred embodiment of the present invention, a prepurge timer is arranged for starting to count time at the time when the burner starts combustion. The prepurge timer functions to start the first comparing means when it counts predetermined set time. An oxygen sensor such as a gas sensor of the galvanic cell type generally fails to cause the output to be proportional to oxygen concentration until a predetermined period of time elapses after it is started, even when it is within its serviceable temperature range, resulting in malfunction of the control system. The above-described construction of the present invention effectively eliminates the problem.

In a preferred embodiment of the present invention, as the initial value stored in the reference value storing means is used a critical value which is determined so as to permit the output of the oxygen sensor to be proportional to oxygen concentration at a level of the critical value or more. Such construction permits the abnormality detecting signal to be positively generated when the detected oxygen concentration value is lower than the critical value. Setting of the initial value to a suitable level permits deterioration of the oxygen sensor to be detected, resulting in the abnormality detecting signal.

In a preferred embodiment of the present invention, a postpurge timer is arranged for starting to count time at the time when the burner stops combustion. The postpurge timer generates a signal when it counts predetermined set time and is reset when the burner restarts combustion before completing the counting. Also, a reset means which is started by the output of the postpurge timer is provided so as to reset the reference value storing means. When the burner is restarted after combustion of the burner is stopped due to generation of the abnormality detecting signal and before air in the room is replaced with external air to cause oxygen concentration in the room to reach a normal value, there occurs a possibility that the oxygen sensor operates while misunderstanding oxygen concentration which causes the low oxygen concentration condition as optimum oxygen concentration, to thereby fail to generate the abnormality detecting signal although oxygen concentration actually is at a level causing the low oxygen concentration condition. The above-described construction of the present invention eliminates the disadvantage.

In a preferred embodiment of the present invention, a room temperature detector is arranged for detecting a temperature of the room in which the burner is placed and a means is arranged for generating the abnormality judging reference value varied depending upon the room temperature detected by the room temperature detector, so that correction of the abnormality judging reference value with respect to a temperature may be accomplished. The dependence of the oxygen sensor on a temperature is increased with a reduction in ambient temperature, thus, a degree to which a voltage output from the oxygen sensor is lowered under the low oxygen concentration condition when the ambient temperature is low is high as compared with that when the ambient temperature is high. Also, ventilation often causes the ambient temperature of the oxygen sensor to be lowered, resulting in the output of the oxygen sensor to be reduced correspondingly. Such situations possibly increase the deviation between the detected oxygen concentration value and the oxygen concentration reference value irrespective of oxygen concentration in the room being normal. The above-described construction of the present invention permits the abnormality judging reference value to be corrected depending upon the room temperature detected by the room temperature detector, to thereby effectively prevent malfunction of the control system.

Further, in a preferred embodiment of the present invention, an abnormality detecting means is provided for detecting abnormality of the oxygen sensor, which abnormality detecting means is adapted to generate an abnormality detecting signal when the output of the oxygen concentration detecting means is below a serviceable limit value of the oxygen sensor. When the highest oxygen concentration detected after the measuring is started is regarded as normal oxygen concentration, the control system operates even if the oxygen sensor fails in normal detection operation due to deterioration of the oxygen sensor, excessive lowering of the ambient temperature or the like. The arrangement of the abnormality detecting means eliminates the disadvantage.

The oxygen sensor, when the ambient temperature is lowered to a serviceable limit temperature of the oxygen sensor or below, exhibits characteristics distinctly different from those exhibited when the oxygen sensor is within a normal serviceable temperature range. Thus, in such a situation, the control system fails to employ a normal control mode wherein the highest oxygen concentration detected after the measuring is started is defined as the oxygen concentration reference value. For example, an oxygen sensor of the galvanic cell type is highly decreased in output when the ambient temperature is lowered to a level as low as several centigrades, whereas the output is rapidly restored and increased with an increase in ambient temperature. However, the output of the oxygen sensor continues to be increased irrespective of a decrease in oxygen concentration in the room, when it is being restored. Thus, the control system possibly fails to detect the low oxygen concentration condition when it is in the normal control mode.

In order to avoid the disadvantage, a preferred embodiment of the present invention may further employ a low temperature control mode which permits the low oxygen concentration condition to be detected even when the ambient temperature is lowered below the serviceable limit temperature. More particularly, the control system of the present invention may further comprise a temperature sensor arranged adjacent to the oxygen sensor, a third comparing means, a control mode change means, a comparison value operating means, and a fourth comparing means. The third comparing means and control mode change means function to carry out switching between the normal control mode and the low temperature control mode. The third comparing means compares a temperature detected by the temperature sensor with a reference temperature at the time when the burner starts combustion, to thereby generate a low temperature detecting signal when the detected temperature is lower than the reference temperature. The control mode change means invalidates control carried out by the first and second comparing means when the low temperature detecting signal is input thereto. The comparison value operating means provides an oxygen concentration comparison value by operation based on at least and the temperature detected by the temperature sensor and input thereto, when the third comparing means generates the low temperature detecting signal. The fourth comparing means compares the oxygen concentration comparison value with the detected oxygen concentration value, to thereby generate the abnormality detecting signal when the deviation between the detected oxygen concentration value and the oxygen concentration comparison value is larger than a low temperature abnormality judging reference value.

The comparison value operating means utilizes a variation in ambient temperature of the oxygen sensor (detected temperature) to obtain a manner of variation of the detected oxygen concentration value from the initial value by operation, supposing that the normal combustion continues. The relationship of a variation in detected oxygen concentration value to that in detected temperature is previously determined by an experiment. The variation in oxygen concentration provided by operation may be expressed in the form of a two-dimensional curve. Even when the output of the oxygen sensor does not follow the variation in oxygen concentration, the output is affected by the variation. Thus, the comparison between the detected oxygen concentration value and the oxygen concentration comparison value permits the low oxygen concentration condition to be detected. Also, a room temperature detector may be arranged to measure the room temperature so that the temperature is considered in the operation by the comparison value operating means.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Now, a control system for a burner according to the present invention will be described hereinafter with reference to the accompanying drawings.

Figure 1:
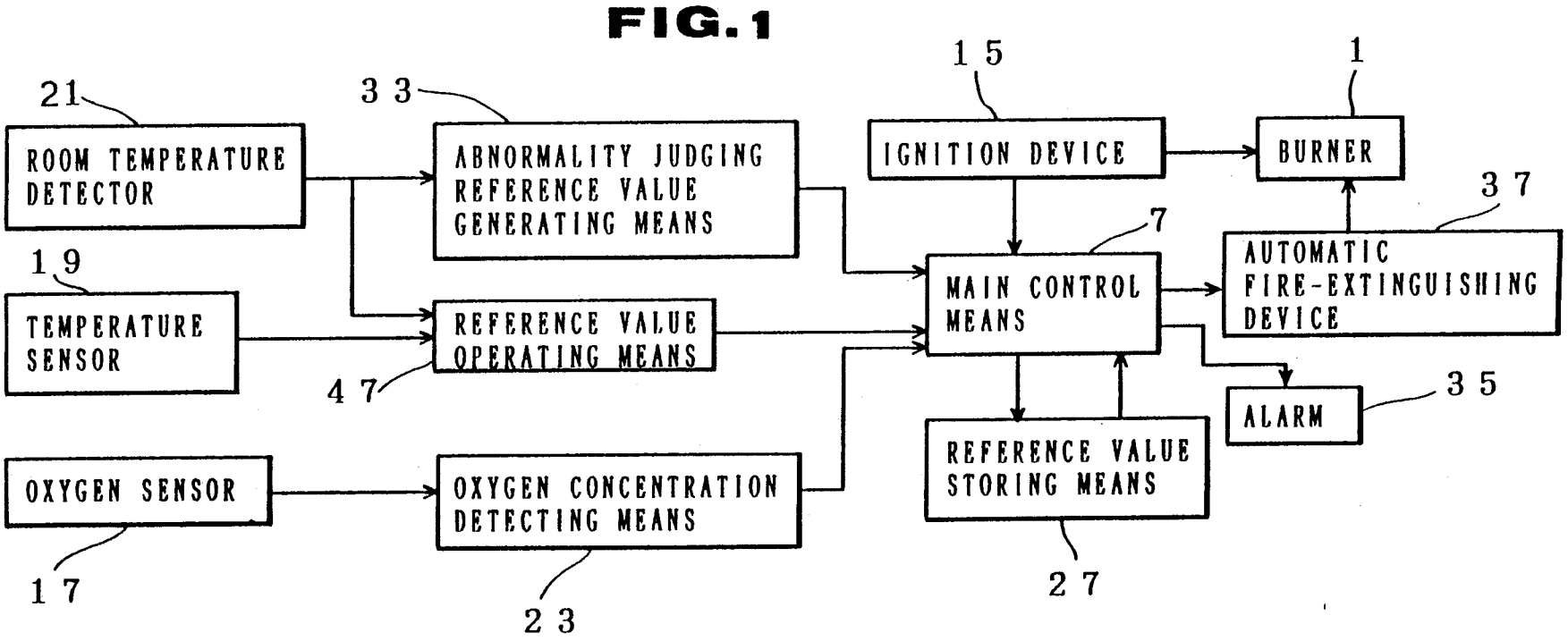
FIG. 1 is a block diagram generally showing an embodiment of a control system for a burner according to the present invention which is constructed in a manner to be used for an oil burner of the wick actuating type.
Figure 2:
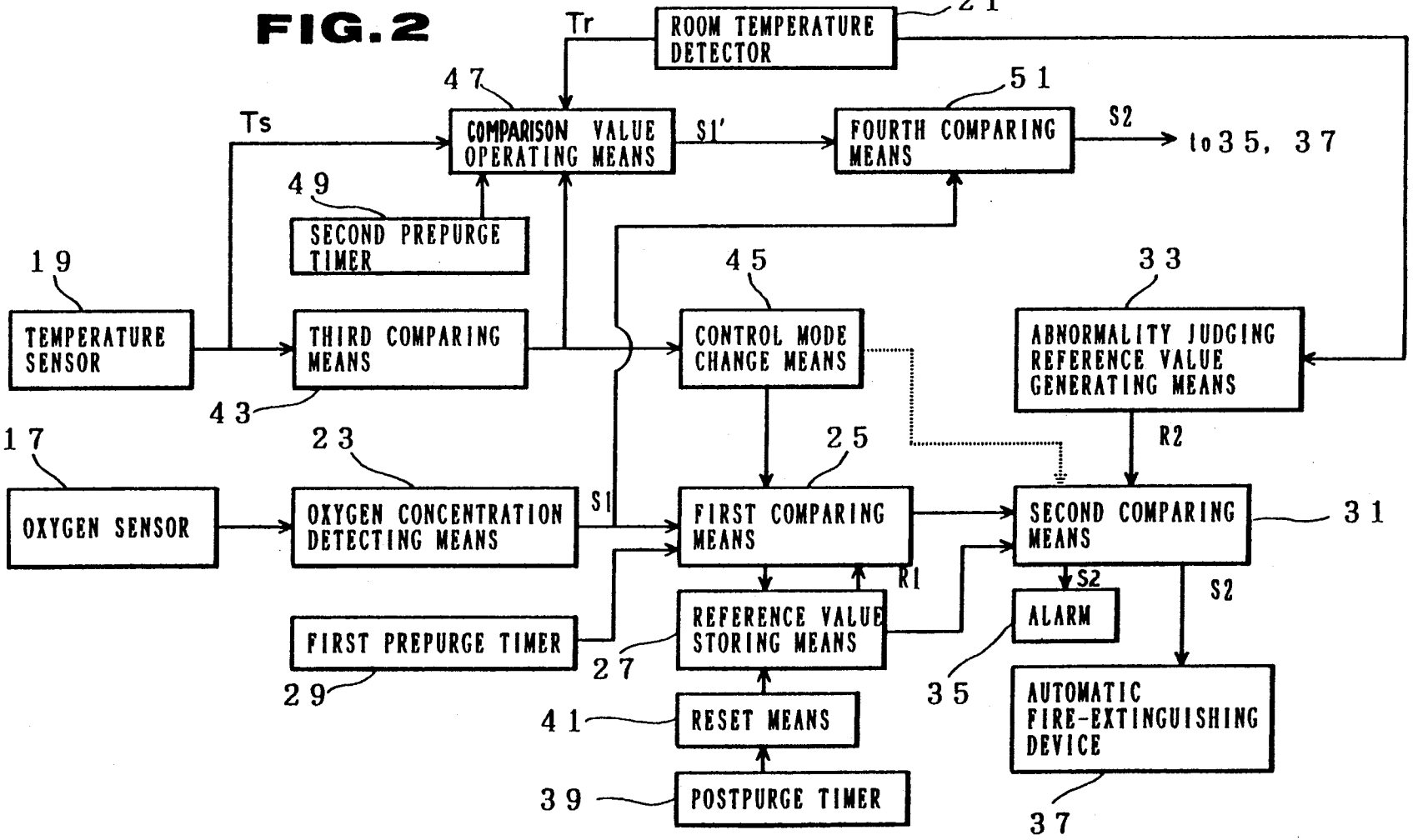
FIG. 2 is a block diagram more definitely showing the control system shown in FIG. 1.
Figure 3:
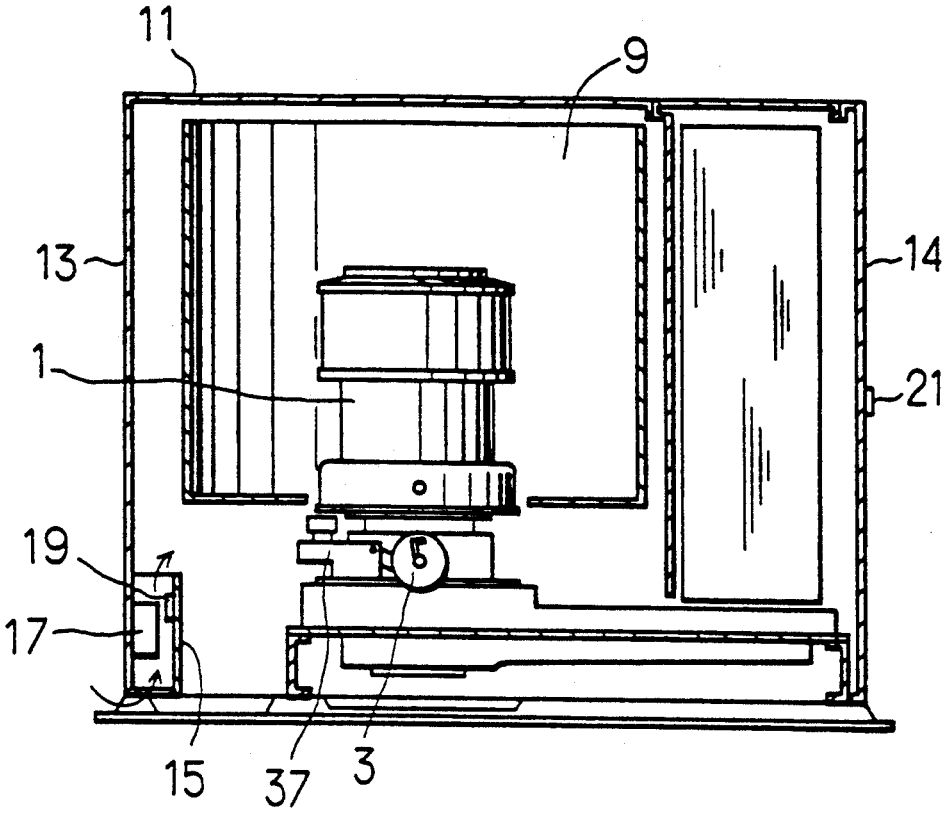
FIG. 3 is a schematic sectional view showing an example of an oil burner of the wick actuating type to which the control system shown in FIG. 1 may be applied.

FIGS. 1 and 2 show an embodiment of a control system of the present invention and FIG. 3 shows an oil burner of the wick actuating type which is an example of a burner to which the control system shown in FIGS. 1 and 2 may be applied. In the illustrated embodiment, a microcomputer is used for control.

In FIGS. 1 to 3, reference numeral 1 designates an oil burner of the wick actuating type which is adapted to vertically move a wick for the igniting and fire-extinguishing operations. The combustion operation of the oil burner is started by moving the wick to a wick raised position or an ignition position through a wick actuating mechanism 3 and then igniting the wick by means of an ignition device 5. In the illustrated embodiment, the wick actuating mechanism 3 is adapted to actuate in association with a power switch (not shown) for the control system. More particularly, the power switch is rendered closed in the course of moving the wick to the wick raised position through the wick actuating mechanism 3, so that a voltage is applied to the control system from a power supply which comprises a dry cell or battery. Then, when the wick is further moved to the wick raised position, the ignition device 5 is actuated, resulting in the oil burner starting combustion. When the power switch is closed, a voltage Vb of the battery and a reference voltage Vr are compared to check the battery. The check may be carried out using any suitable techniques conventionally known in the art. When any abnormality is detected in the power supply, an automatic fire-extinguishing mechanism 37 which will be described hereinafter is actuated to prevent the ignition; whereas non-detection of the abnormality permits the ignition to be carried out. In the illustrated embodiment, the battery check is carried out by means of a battery check circuit incorporated in a main control means 7. The main control means 7 includes a comparing and judging means, which will be described hereinafter together with other means.

The burner 1 is so arranged that its upper portion is positioned in a space defined in a casing 11 and surrounded by a reflection plate 9 and its lower portion is housed in the lower section of the casing 11. On the inner surface of one side wall of the casing 11 is fixedly mounted a duct 15, which is formed at both upper and lower ends thereof with openings. The lower opening of the duct 15 communicates with an opening formed at the bottom of the casing 11, so that air may be introduced from the exterior of the casing 11 through the duct 15 into the casing 11. In the duct 15 are arranged an oxygen sensor 17 and a temperature sensor 19. For this purpose, the illustrated embodiment uses an oxygen sensor of the galvanic cell type. The temperature sensor 19 is used for measuring an ambient temperature of the oxygen sensor which is a temperature of an environment in which the oxygen sensor 17 is arranged. On the outer surface of the other side wall 14 of the casing 11 is mounted a temperature detector 21 for detecting a room temperature or a temperature of a room in which the burner is placed.

The oxygen sensor 17 of the galvanic cell type is adapted to react with gaseous oxygen to generate an electric signal proportional to concentration of the oxygen reacted therewith. Thus, the oxygen sensor 17 generates an analog signal proportional to concentration of the reacted oxygen. In order to carry out processing of the analog signal using a microcomputer, it is required to convert the analog signal into a digital signal. An oxygen concentration detecting means 23 comprises an amplifier for amplifying the analog signal and an A/D converter for converting the amplified analog signal into a digital signal. Thus, the oxygen concentration detecting means 23 functions to generate a detected oxygen concentration value S1 which is proportional to oxygen concentration and indicated in the form of a digital signal. The detected oxygen concentration value S1 is then supplied to a first comparing means 25 in order to detect maximum or the highest oxygen concentration during the detecting operation. The first comparing means 25 compares the detected oxygen concentration value S1 with an oxygen concentration reference value R1 stored in a reference value storing means 27, resulting in the detected oxygen concentration value S1 being stored as a renewed oxygen concentration reference value in the reference value storing means 27 when the detected oxygen concentration value S1 is larger than the oxygen concentration reference value R1. The oxygen concentration detecting operation is repeatedly carried out at a predetermined cycle or, for example, at time intervals of 10 seconds. In the reference value storing means is previously stored an initial value in order to ensure that it attains an initial comparing operation. The first comparing means 25 starts the operation after a first prepurge timer 29 which is adapted to start to count time at the time when the ignition of the burner 1 is started completes counting of predetermined set time. In the illustrated embodiment, a critical value which causes a variation in output of the oxygen sensor to be proportional to oxygen concentration at a level of the critical value and above is used as the initial value to be stored in the reference value storing means 27.

Figure 4A:
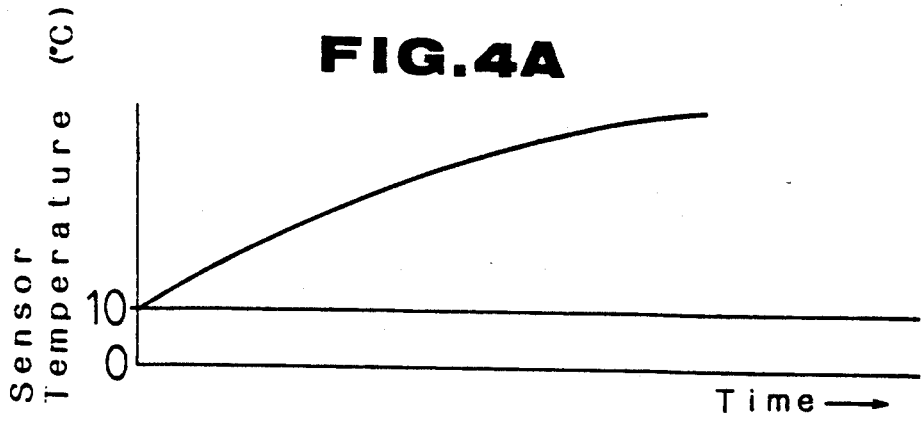
FIG. 4A is a graphical representation showing an example of the relationship between combustion time of a burner and an ambient temperature of an oxygen sensor which is measured by a temperature sensor, when the temperature is at a serviceable temperature of the oxygen sensor or above.
Figure 4B:
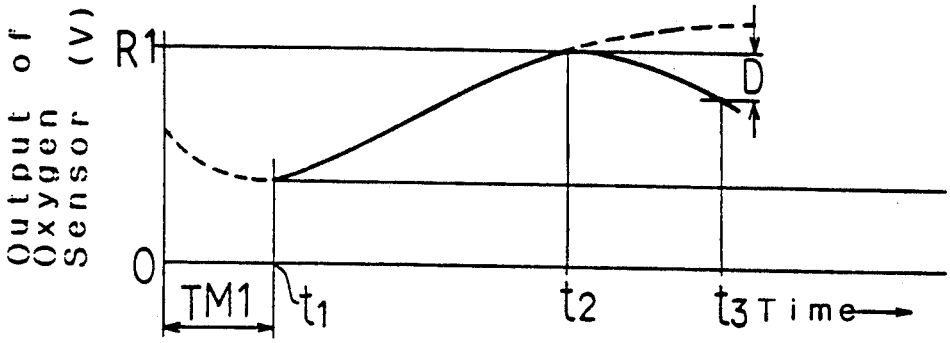
FIG. 4B is a graphical representation showing an example of the relationship between combustion time of a burner and a voltage output from an oxygen sensor.

The first prepurge timer 29 is used in view of the fact that the oxygen sensor of the galvanic cell type has characteristics of failing to render the output of the sensor proportional to oxygen concentration until a predetermined period of time elapses from turning-on of the oxygen sensor even when it is at a serviceable temperature. FIG. 4A shows an example of the relationship between combustion time of the burner 1 and the ambient temperature of the oxygen sensor (sensor temperature) which relationship is obtained when the ambient temperature is at a serviceable temperature of the oxygen sensor (5° C.) or more. The sensor temperature or ambient temperature is measured by the temperature sensor 19. FIG. 4B shows an example of the relationship between the combustion time and a voltage generated from the oxygen sensor 17. As will be noted from FIGS. 4A and 4B, the output voltage of the oxygen sensor 17 is reduced irrespective of oxygen concentration from the start of combustion of the burner 1 to time t1 and increased in proportion to a variation in oxygen concentration after the time t1 elapses. In view of the above, the first prepurge timer 29 is constructed so as to have time TM1 equal to or more than the time t1 set therein, resulting in causing the first comparing means 25 to start the operation after the output of the oxygen sensor 17 is rendered normal. In the illustrated embodiment, the set time TM1 is determined to be 20 minutes.

When oxygen concentration in a room in which the burner is placed is normal, the output of the oxygen sensor is increased as indicated at broken lines in FIG. 4B. This results in the first comparing means 25 functioning to cause the oxygen concentration reference value R1 stored in the reference value storing means 27 to be renewed. When the room is tightly closed to a degree sufficient to cause a reduction in oxygen concentration to be started at time t2, the oxygen concentration reference value R1 obtained at the time t2 is maximum or the highest oxygen concentration. Then, the first comparing means 25 supplies the detected oxygen concentration value S1 to a second comparing means 31. The second comparing means 31 functions to compare the deviation D(=R1−S1) between the detected oxygen concentration value S1 and the oxygen concentration reference value R1 with an abnormality judging reference value R2 generated by a means for generating an abnormality judging reference value (abnormality judging reference value generating means) designated at reference numeral 33, to thereby generate an abnormality detecting signal S2 to at least one of an alarm 35 and the automatic fire-extinguishing device 37. The automatic fire-extinguishing device 37 belongs to the category of a combustion reducing device for reducing the amount of combustion and, in the present invention, the combustion reducing device is referred to a device for carrying out a reduction in combustion as well as fire-extinguishing. A burner which slowly causes abnormal combustion because of a low heat release value, such as an oil burner of the wick actuating type may cope with a low oxygen concentration condition by a decrease in combustion, so that the fire-extinguishing is not required.

The illustrated embodiment, as described above, is so constructed that the second comparing means 31 is used for obtaining the deviation D between the detected oxygen concentration value, S1 and the oxygen concentration reference value R1. However, it may be obtained through the first comparing means 25.

The abnormality judging reference value generating means 33 is adapted to generate the abnormality judging reference value R2 depending upon the room temperature detected by the temperature detector 21. The abnormality judging reference value R2 generated from the means 33 is decreased as the room temperature is lowered. However, when the room temperature detector 21 detects a rapid variation in room temperature due to, for example, blowing of cold air against it, the reference value generating means 33 carries out correction so as to cause the abnormality judging reference value R2 to be temporarily increased.

When the wick actuating mechanism 3 is manually actuated or the fire-extinguishing device 37 is automatically actuated, to thereby cause the wick to be lowered to a fire-extinguishing position, the power switch (not shown) is rendered open to electrically isolate the control system from the power supply. In the illustrated embodiment, the postpurge timer 39 and a reset means 41 are provided in order to ensure that the oxygen concentration reference value R1 stored in the reference value storing means 27 is maintained for a predetermined period of time after the power switch is open. This causes the oxygen concentration reference value R1 to be maintained until counting of set time of the postpurge timer 39 is completed; therefore, the abnormality detecting signal is generated immediately after the low oxygen concentration condition is produced in the room. Thus, restarting of combustion before oxygen concentration in the room reaches a normal value can be effectively prevented.

The foregoing description has been made on the basis of a normal control mode wherein the ambient temperature of the oxygen sensor 17 or the temperature of an environment surrounding the oxygen sensor 17 is within the serviceable temperature range of the sensor. Now, a low temperature control mode which is carried out under the conditions that the ambient temperature of the oxygen sensor 17 is below the serviceable temperature range will be described hereinafter.

Figure 5A:
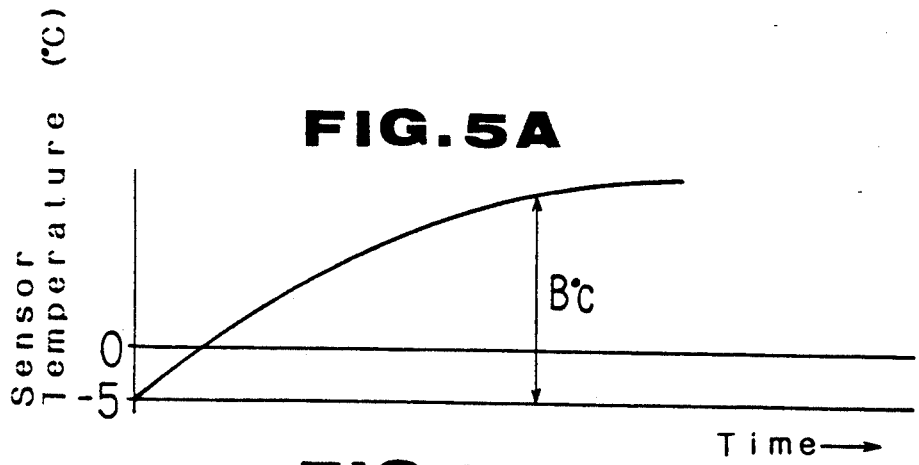
FIG. 5A is a graphical representation showing an example of the relationship between combustion time of a burner and an ambient temperature of an oxygen sensor which is measured by a temperature sensor, when the temperature is lowered to a level below a serviceable temperature of the oxygen sensor.
Figure 5B:
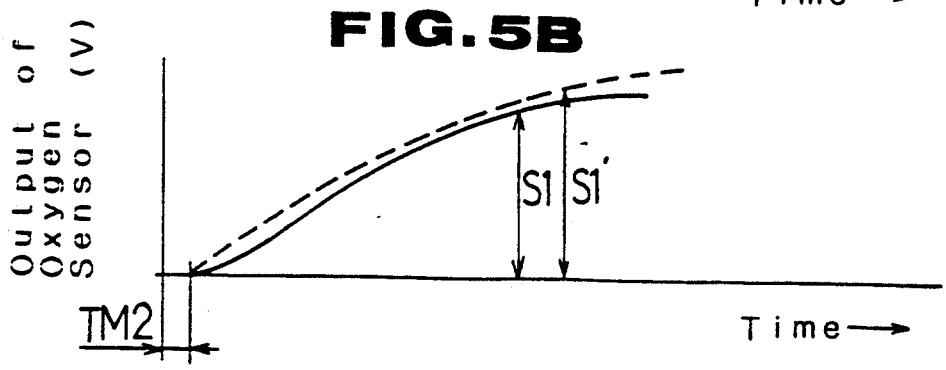
FIG. 5B is a graphical representation showing an example of the relationship between combustion time of a burner and a voltage output from an oxygen sensor of the galvanic cell type.

FIG. 5A shows an example of the relationship between combustion time of the burner and the ambient temperature of the oxygen sensor (sensor temperature) measured by the temperature sensor 19 which relationship is obtained when the temperature is lowered to a level below the serviceable temperature of the oxygen sensor or 5° C. and FIG. 5B shows an example of the relationship between combustion time of the burner and a voltage output from the oxygen sensor 17 of the galvanic cell type. A curve defined by a solid line in FIG. 5B indicates a voltage output from the oxygen sensor 17. As will be readily noted from the comparison between the curve in FIG. 5B and that in FIG. 4B, when the ambient temperature is lowered below the serviceable temperature, the output voltage is highly reduced; whereas it is rapidly restored and increased with an increase in ambient temperature. However, in the course of the output voltage being restored, the output of the oxygen sensor is continuously increased even when oxygen concentration in the room is decreased in a direction of causing the low oxygen concentration condition. However, the output voltage is somewhat affected by a decrease in oxygen concentration while the voltage is being restored. More particularly, an increase in output voltage is reduced with a decrease in oxygen concentration. Thus, in the low temperature control mode, the low oxygen concentration condition is detected depending upon the magnitude of the deviation between the detected oxygen concentration value and a comparison operation value which is the output voltage of the oxygen sensor obtained in the form of a comparison value by operation on the assumption that oxygen concentration in the room is not lowered to a level of the low oxygen concentration condition. A curve defined by broken lines in FIG. 58 indicates an example of the oxygen concentration comparison value obtained by operation.

In order to realize the low temperature control mode, a third comparing means 43 is provided for judging whether the low temperature control mode is to be selected. The third comparing means 43 has a serviceable limit temperature To of the oxygen sensor previously input thereto as one comparison value. The third comparing means 43 functions to compare an initial value T1 of the temperature sensor 19 with the serviceable limit temperature To, resulting in supplying a low temperature detecting signal to a control mode change means 45 and a comparison value operating means 47 when the initial value T1 is smaller than the serviceable limit temperature To. When the low temperature detecting signal is input to the control mode change means 45, it invalidates control of the normal control mode carried out through the first comparing means 25 and second comparing means 31. The invalidation is accomplished by rendering any one of the first and second comparing means 25 and 31 inoperative.

The comparison value operating means 47 starts the operation when the second prepurge timer 49, which starts to count set time TM2 upon closing of the power switch, completes the counting. The set time TM2 is determined to be much shorter than the set time TM1 of the first prepurge timer 29 used in the normal control mode. For example, it may be set to be as short as, for example, 20 seconds. The second prepurge timer 49 may be eliminated depending upon the characteristics of the oxygen sensor.

The comparison value operating means 47, when the third comparing means 43 generates the low temperature detecting signal, generates an oxygen concentration comparison value S1′ based on a room temperature Tr measured by the room temperature detector 21 and input thereto and a temperature Ts detected by the temperature sensor 19 and input thereto. A fourth comparing means designated by reference numeral 51 functions to compare the oxygen concentration comparison value S1′ with the detected oxygen concentration value S1 supplied from the oxygen concentration detecting means 23, resulting in generating an abnormality detecting signal S2 when the deviation d (=S1′−S1) between the oxygen concentration comparison value S1′ and the detected oxygen concentration value S1 is larger than a low temperature abnormality judging reference value R3. In the illustrated embodiment, the low temperature abnormality judging reference value R3 is previously stored in the fourth comparing means 51. When a temperature correction is required as in the normal control mode described above, a means for generating a low temperature abnormality judging reference value may be provided, which may be constructed in a manner similar to the abnormality judging reference value generating means 33.

The comparison value operating means 47, on the assumption that normal combustion is continuously carried out, determines, by operation, a manner in which the detected oxygen concentration value is varied from its initial value, depending upon variations in room temperature Tr and ambient temperature Ts of the oxygen sensor. The relationship between a variation in detected oxygen concentration value and variations in room temperature Tr and detected temperature Ts is previously determined by an experiment. The oxygen concentration comparison value S1′ which is obtained by operation may be obtained according to the operational formula $S1' = Tr \times \alpha + Ts \times \beta$, wherein $\alpha$ and $\beta$ each are a coefficient. The operational formula is one example, therefore, it is a matter of course that any other suitable operational formula may be conveniently used for this purpose.

In the illustrated embodiment, the room temperature measured by the room temperature detector 21 is subject to operation in order to further enhance the accuracy. In this connection, the arrangement of the temperature sensor 19 in the duct 15 through which air in the room is introduced from the room into the burner causes a temperature of the room to affect the temperature sensor 19. Such a problem may be eliminated by obtaining the oxygen concentration comparison value S1′ by means of only the output of the temperature sensor 19 without using the output of the room temperature detector 21.

Figure 6:
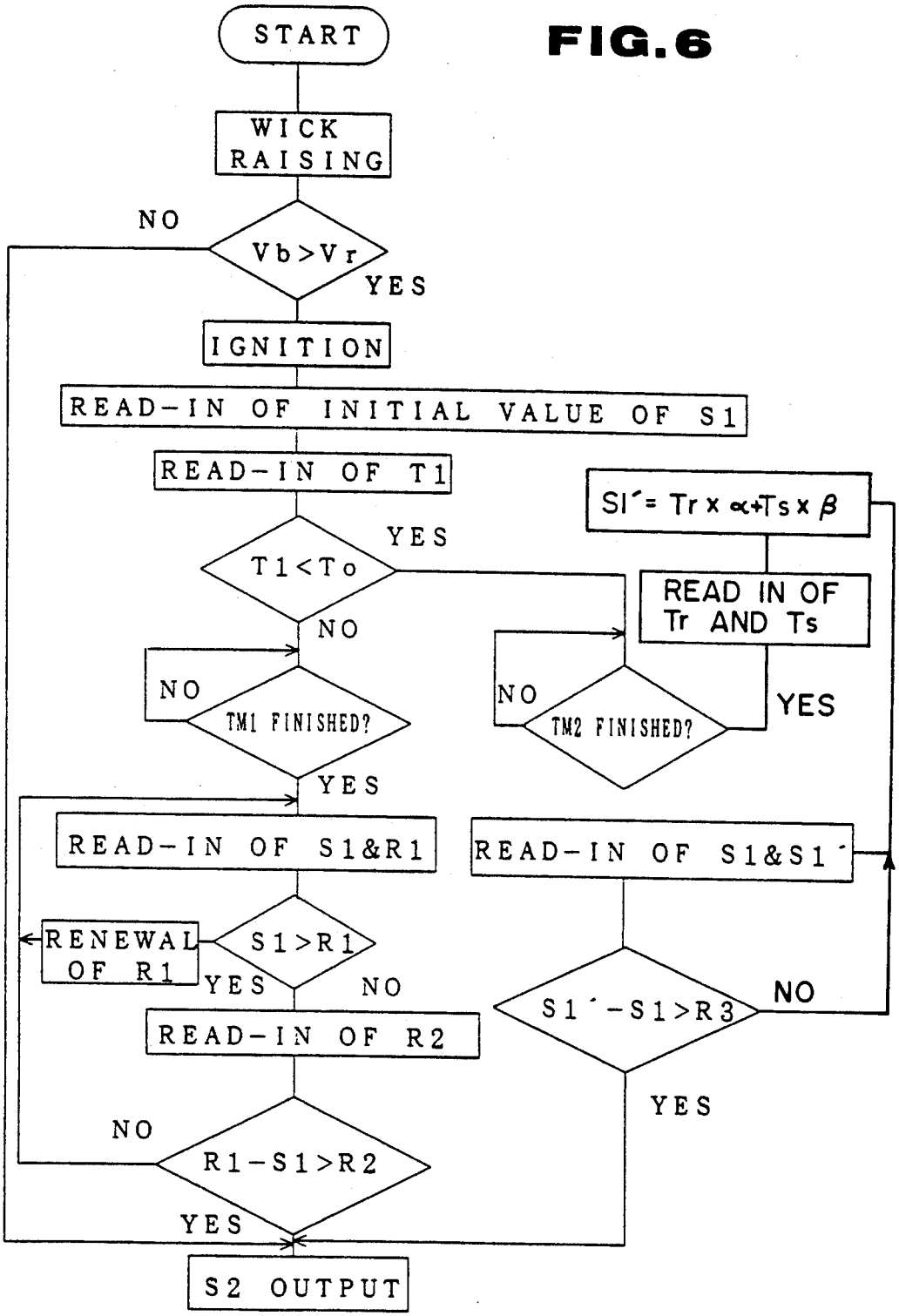
FIG. 6 is a flow chart showing the operation of the control system shown in FIG. 2.

FIG. 6 shows the manner of practicing the embodiment shown in FIG. 2 using a microcomputer. However, the operation of the postpurge timer 39 is eliminated from FIG. 6.

Figure 7:
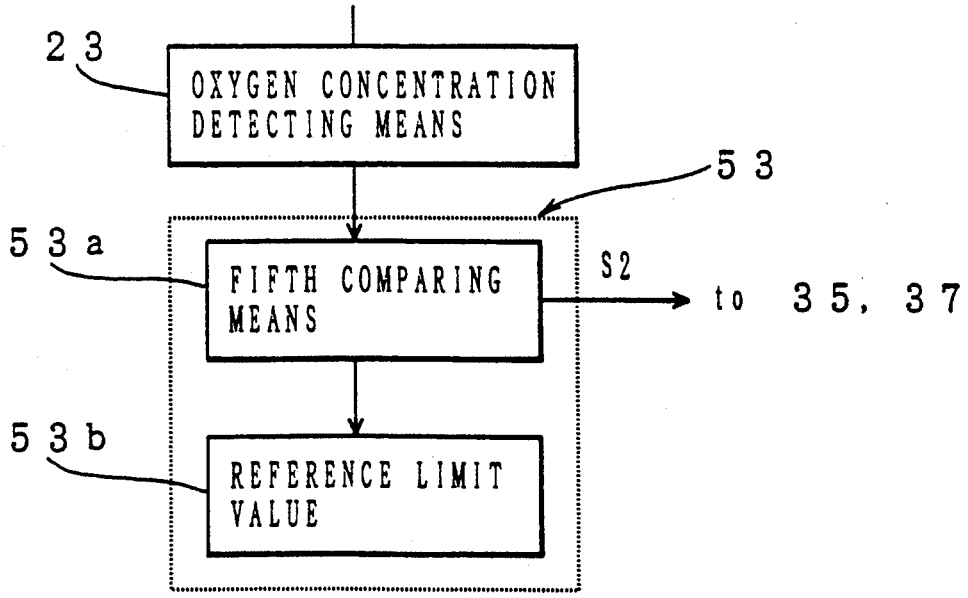
FIG. 7 is a block diagram showing an additional means which may be incorporated in the control system shown in FIG. 2.

The illustrated embodiment, as shown in FIG. 7, may include a means 53 for detecting abnormality of the oxygen sensor to generate an abnormality detecting signal S2 when the detected oxygen concentration value S1 generated from the oxygen concentration detecting means 23 is below a serviceable limit value of the oxygen sensor 17. The abnormality detecting means 53 may comprise a fifth comparing means **53*a* and a means 53*b* for storing the serviceable limit value and be adapted to compare the detected oxygen concentration value S1 generated from the oxygen concentration detecting means 23** with the serviceable limit value, resulting in generating the abnormality detecting signal S2 when the detected oxygen concentration value S1 is below the serviceable limit value.

As can be seen from the foregoing, the control system of the present invention is so constructed that even when a variation in ambient temperature causes the detected oxygen concentration value to be varied, the low oxygen concentration condition can be detected while being prevented from being substantially affected by the variation in ambient temperature because oxygen concentration generating the abnormality detecting signal is determined on the basis of maximum oxygen concentration.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A control system for a burner having at least one of an alarm and a combustion reducing device which is actuated in response to an abnormality detecting signal indicating an abnormal oxygen concentration, said control system comprising:

an oxygen sensor adapted to react with oxygen gas to generate an electric signal depending upon an oxygen concentration in a room in which the burner is placed;

oxygen concentration detecting means responsive to the electric signal supplied from said oxygen sensor for generating a detected oxygen concentration value;

first comparing means or comparing said detected oxygen concentration value with an oxygen concentration reference value;

reference value storing means for storing an initial reference value and said detected oxygen concentration value and inputting the oxygen concentration reference value to said first comparing means, said reference value storing means including means to initially input said initial reference value as the oxygen concentration reference value inputted to said first comparing means, and means to thereafter input said detected oxygen concentration value as the oxygen concentration reference value inputted to said first comparing means when said first comparing means detects that said detected oxygen concentration value is larger than the oxygen concentration reference value previously inputted to said first comparing means; and, second comparing means for comparing a deviation between said detected oxygen concentration value and the oxygen concentration reference value with an abnormality judging reference value, and for generating said abnormality detecting signal when said deviation is larger than said abnormality judging reference value and said first comparing means detects that said detected oxygen concentration value is smaller than the oxygen concentration reference value.

2. A control system as defined in claim 1, wherein said burner is housed in a casing in which a duct is provided for introducing air from the room into the burner, said oxygen sensor being arranged in said duct.

3. A control system as defined in claim 2 further comprising:

a temperature sensor arranged adjacent to said oxygen sensor;

third comparing means for comparing a temperature detected by said temperature sensor with a reference temperature at the time when said burner starts combustion, and for generating a low temperature detecting signal when said detected temperature is lower than said reference temperature;

control mode change means responsive to said low temperature detecting signal for invalidating control carried out by said first and second comparing means;

comparison value operating means for providing an oxygen concentration comparison value based on at least the temperature detected by said temperature sensor when said third comparing means generates said low temperature detecting signal; and, fourth comparing means for comparing said oxygen concentration comparison value with said detected oxygen concentration value, and for generating said abnormality detecting signal when the deviation between said detected oxygen concentration value and said oxygen concentration comparison value is larger than a low temperature abnormality judging reference value.

4. A control system as defined in claim 2, wherein said burner is an oil burner of the wick actuating type.

5. A control system as defined in claim 1 further comprising a prepurge timer for counting time from the time when said burner starts combustion, said prepurge timer including means for starting said first comparing means when a predetermined set time has been counted.

6. A control system as defined in claim 5, wherein said burner is an oil burner of the wick actuating type.

7. A control system as defined in claim 1, further comprising a room temperature detector for detecting a temperature of the room in which said burner is placed; and means for varying said abnormality judging reference value depending upon the room temperature detected by said room temperature detector.

8. A control system as defined in claim 7, wherein said burner is an oil burner of the wick actuating type.

9. A control system as defined in claim 1, further comprising an abnormality detecting means for detecting an abnormality of said oxygen sensor;

said abnormality detecting means including means for generating said abnormality detecting signal when the output of said oxygen concentration detecting means is below a serviceable limit value of said oxygen sensor.

10. A control system as defined in claim 9, wherein said burner is an oil burner of the wick actuating type.

11. A control system as defined in claim 1, wherein said burner is an oil burner of the wick actuating type.

12. A control system as defined in claim 1, wherein said initial reference value stored in said reference value storing means comprises a critical value which is determined so as to permit the output of said oxygen sensor to be proportional to oxygen concentration at a level of said critical value and above.

13. A control system as defined in claim 4 further comprising:

a postpurge timer for counting time from the time when said burner stops combustion, said postpurge timer including means for generating an output when a predetermined set time has been counted, and means for resetting said postpurge timer when said burner restarts combustion before completion of said counting; and, reset means started by the output of said postpurge timer for resetting said reference value storing means to input said initial reference value as the oxygen concentration reference value inputted to said first comparing means.

14. A control system as defined in claim 13, wherein said burner is an oil burner of the wick actuating type.

15. A control system as defined in claim 12, wherein said burner is an oil burner of the wick actuating type.

16. A control system as defined in claim 1 further comprising:

a temperature sensor arranged adjacent to said oxygen sensor;

third comparing means for comparing a temperature detected by said temperature sensor with a reference temperature at the time when said burner starts combustion, and for generating a low temperature detecting signal when said detected temperature is lower than said reference temperature;

control mode change means responsive to said low temperature detecting signal for invalidating control carried out by said first and second comparing means;

comparison value operating means for providing an oxygen concentration comparison value based on at least the temperature detected by said temperature sensor when said third comparing means generates said low temperature detecting signal; and, fourth comparing means for comparing said oxygen concentration comparison value with said detected oxygen concentration value, and for generating said abnormality detecting signal when the deviation between said detected oxygen concentration value and said oxygen concentration comparison value is larger than a low temperature abnormality judging reference value.

17. A control system as defined in claim 16 further comprising a room temperature detector for detecting a temperature in the room in which said burner is placed, and wherein said comparison value operating means includes means for providing said oxygen concentration comparison value based on both the temperature detected by said temperature sensor and the temperature detected by said room temperature detector.

18. A control system as defined in claim 17, wherein said burner is an oil burner of the wick actuating type.

19. A control system as defined in claim 16, wherein said burner is an oil burner of the wick actuating type.

20. A control system as defined in claim 16, wherein said oxygen sensor is of the galvanic cell type.

* * * * *

UNITED STATES PATENT AND TRADEMARK OFFICE

CERTIFICATE OF CORRECTION

PATENT NO. : 5,203,687

DATED : April 20, 1993

INVENTOR(S) : Yukihiro OGUCHI

It is certified that error appears in the above-identified patent and that said Letters Patent is hereby corrected as shown below:

Claim 1, line 14, change "or" to --for--.

Signed and Sealed this

Fourth Day of January, 1994

*Attest:*

*Attesting Officer*

Bruce Lehman

BRUCE LEHMAN

*Commissioner of Patents and Trademarks*